US011632979B2

(12) United States Patent
Taylor

(10) Patent No.: US 11,632,979 B2
(45) Date of Patent: Apr. 25, 2023

(54) SMOKELESS TOBACCO ALTERNATIVE KIT AND METHOD OF USE

(71) Applicant: Christopher Taylor, Delray Beach, FL (US)

(72) Inventor: Christopher Taylor, Delray Beach, FL (US)

(73) Assignee: ZOI BRANDS LLC, Delray Beach, FL (US)

( * ) Notice: Subject to any disclaimer, the term of this patent is extended or adjusted under 35 U.S.C. 154(b) by 396 days.

(21) Appl. No.: 17/026,128

(22) Filed: Sep. 18, 2020

(65) Prior Publication Data

US 2021/0076729 A1 Mar. 18, 2021

Related U.S. Application Data

(60) Provisional application No. 62/901,894, filed on Sep. 18, 2019.

(51) Int. Cl.
*A24B 15/16* (2020.01)

(52) U.S. Cl.
CPC ..... *A24B 15/16* (2013.01)

(58) Field of Classification Search
None
See application file for complete search history.

(56) References Cited

U.S. PATENT DOCUMENTS

2017/0164651 A1* 6/2017 Mua ..... A24B 15/10
2018/0153211 A1* 6/2018 Persson ..... B65B 9/067

* cited by examiner

*Primary Examiner* — Dennis R Cordray
(74) *Attorney, Agent, or Firm* — Mark C. Johnson; Johnson Dalal

(57) ABSTRACT

A smokeless tobacco alternative kit having a container defining a strip cavity and having a lid, the container and lid operably configured to couple together to encapsulate the strip cavity and a plurality of strips disposed within the strip cavity. Each of the plurality of strips have a first end, a second end opposing the first end of the strip, and a strip length separating the first and second ends of the strip and have a non-woven and absorbent fabric material surrounding and coupled to an absorbent cotton material, wherein the non-woven and absorbent fabric material and the absorbent cotton material spanning the strip length and absorbed with an organic release liquid of a nicotine-free, tobacco-free, and gluten-free liquid operably configured to transport through the fabric material and cotton material when subjected to a compressive force.

19 Claims, 4 Drawing Sheets

SMOKELESS TOBACCO ALTERNATIVE KIT AND METHOD OF USE

FIELD OF THE INVENTION

The present invention relates generally to smokeless tobacco alternatives for personal use by users.

BACKGROUND OF THE INVENTION

Many users use and prefer smokeless tobacco as an alternative to cigarettes. Smokeless tobacco, however, is still associated with many health problems for users, including nicotine addiction, causing cancer of the mouth, esophagus (the passage that connects the throat to the stomach), and pancreas (a gland that helps with digestion and maintaining proper blood sugar levels), causing diseases of the mouth, increasing risks for early delivery and stillbirth when used during pregnancy, causing nicotine poisoning in children, and increasing the risk for death from heart disease and stroke.

Some known devices and methods utilized to provide smokeless tobacco alternatives include a water soluble or insoluble herbal material that is safe for users to place in the user's mouth, but which does not contain either tobacco and nicotine, or tobacco while still retaining nicotine. Like herbal cigarettes and electronic cigarettes, they are often used as a tobacco cessation aid. Herbal smokeless tobacco use is an alternative to using smokeless tobacco that may help users quit. These known devices and method fail, however, to provide users a device that effectively, efficiently, and safely emulate smokeless tobacco in an enjoyable way for users. Additionally, these known devices and method fail to enable users to safely and effectively transport and store smokeless tobacco alternatives.

Therefore, a need exists to overcome the problems with the prior art as discussed above.

SUMMARY OF THE INVENTION

The invention provides a smokeless tobacco alternative kit that overcomes the hereinafore-mentioned disadvantages of the heretofore-known devices and methods of this general type and that emulates smokeless tobacco in an effective, efficient, safe, and enjoyable manner.

With the foregoing and other objects in view, there is provided, in accordance with the invention, a smokeless tobacco alternative kit having a container defining a strip cavity and having a lid, the container and lid operably configured to couple together to encapsulate the strip cavity and a plurality of strips disposed within the strip cavity. Each of the plurality of strips have a first end, a second end opposing the first end of the strip, and a strip length separating the first and second ends of the strip, and have a non-woven and absorbent fabric material surrounding and coupled to an absorbent cotton material. The non-woven and absorbent fabric material and the absorbent cotton material spans the strip length and absorbed with an organic release liquid of a nicotine-free, tobacco-free, and gluten-free liquid operably configured to transport through the fabric material and cotton material when subjected to a compressive force.

In accordance with a further feature of the present invention, the container and the lid are both of a substantially rigid polymeric material and the container and the lid are operably configured to couplable together in a hermetically sealed coupling configuration.

In accordance with another feature, an embodiment of the present invention includes the container having a polymeric seal disposed proximal to the upper edge of a sidewall of the container, the polymeric seal coupling the container and the lid in the hermetically sealed coupling configuration.

In accordance with a further feature of the present invention, the plurality of strips are disposed within the strip cavity in a 4×4 stacked strip configuration with two of the plurality of strips flanking the 4×4 stacked strip configuration.

In accordance with yet another feature, an embodiment of the present invention also includes each of the plurality of strips having a front elongated surface, a rear elongated surface opposing the front elongated surface, and a width separating the front and rear elongated surfaces, wherein the 4×4 stacked strip configuration includes the front elongated surface of the each of the plurality of strips facing upwardly toward the lid and the rear elongated surface of the each of the plurality of strips facing downward toward an inner surface of a bottom wall of the container and two of the plurality of strips flanking the 4×4 stacked strip configuration have either the front or rear elongated surfaces facing and disposed proximal to either the first or second end of each of the plurality of strips in the 4×4 stacked strip configuration.

In accordance with a further feature of the present invention, the width separating the front and rear elongated surfaces uniformly spans the strip length.

In accordance with a further feature of the present invention, the strip cavity consists essentially of a volume ranging from 4.0-5.0 $in^3$.

In accordance with yet another feature of the present invention, the absorbent cotton material has approximately 0.01-0.25 ml of the organic release liquid absorbed therein.

Although the invention is illustrated and described herein as embodied in a smokeless tobacco alternative kit and method of use, it is, nevertheless, not intended to be limited to the details shown because various modifications and structural changes may be made therein without departing from the spirit of the invention. Additionally, well-known elements of exemplary embodiments of the invention will not be described in detail or will be omitted so as not to obscure the relevant details of the invention.

It is to be understood that the disclosed embodiments herein are merely exemplary of the invention, which can be embodied in various forms. Therefore, specific structural and functional details disclosed herein are not to be interpreted as limiting, but merely as a basis for future claims and as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language).

The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the organic-based strip, wherein "transverse" should be understood to mean a direction corresponding to a direction opposite the longitudinal direction.

The attached figures are incorporated in and form part of the specification, and serve to further illustrate various embodiments and explain various principles and advantages all in accordance with the present invention. Moreover, it is believed that the invention will be better understood from a consideration of the following description in conjunction with the drawing figures, in which like reference numerals are carried forward

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION OF INVENTION

Figure 2:
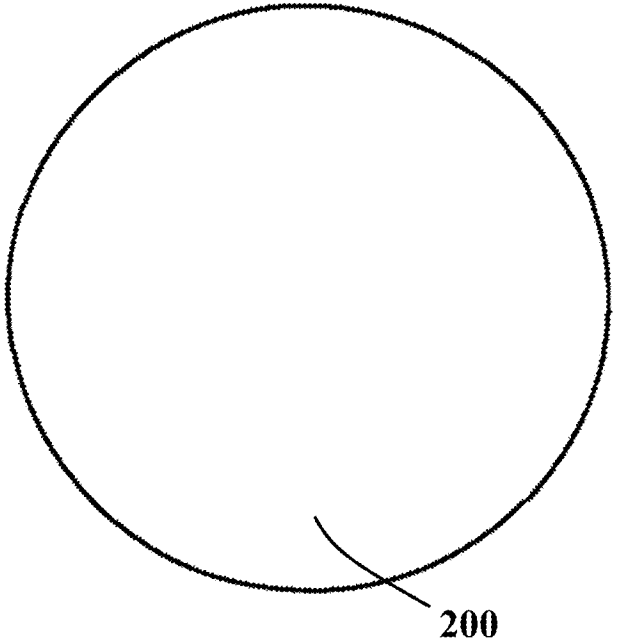
FIG. 2 is a top plan view of a lid utilized in the smokeless tobacco alternative kit in accordance with one embodiment of the present invention.
Figure 1:
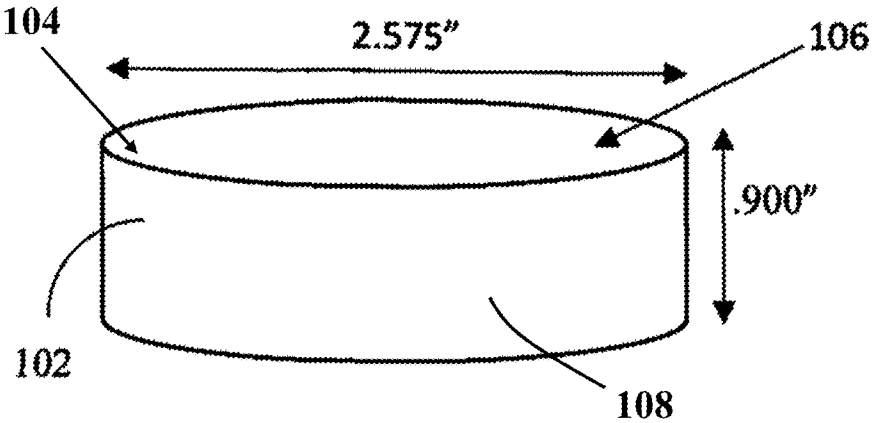
FIG. 1 is a perspective view of a smokeless tobacco alternative kit in accordance with one embodiment of the present invention.
Figure 4:
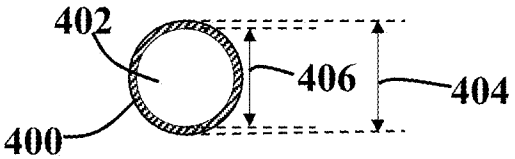
FIG. 4 is a cross-sectional view of a chewing strip in accordance with one embodiment of the present invention.
Figure 5:
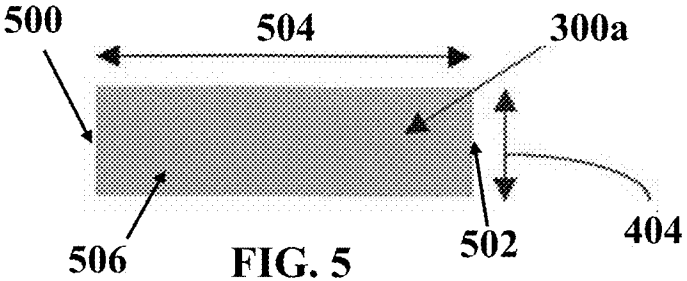
FIG. 5 is a front elevational view of a chewing strip in accordance with one embodiment of the present invention.
Figure 6:
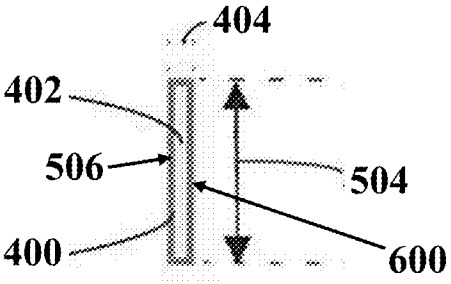
FIG. 6 is a side elevational view of a chewing strip in accordance with one embodiment of the present invention.

The invention described herein provides a smokeless tobacco alternative kit and method of use that overcomes known disadvantages of those known devices and methods of this general type and that enables users to emulate the sensation generated from smokeless tobacco effectively and safely utilizing organic-based strips.

Referring now to FIGS. 1-6, embodiments of the present invention are shown in various views. The figures show several advantageous features of the present invention, but, as will be described below, the invention can be provided in several shapes, sizes, combinations of features and components, and varying numbers and functions of the components. More specifically, a substantially rigid container 102 is operably configured and sized and shaped to house and retain a plurality of strips 300*a-n*, wherein "n" represents any number greater than 1. Another embodiment of the container 800 can be seen in FIGS. 8-12. The container 102, namely an inner surface 104 of a sidewall 108 of the container 102 defines a strip cavity 106 where the strips are placed and may also have a lid 200 operably configured to couple with the container 102 (namely an upper edge or a location proximal thereto) to encapsulate the strip cavity 106. In one embodiment, the lid 200 may be selectively couplable to the container, namely the sidewall 108 of the container 102, in a hermetically sealed coupling configuration. To that end, a polymeric seal 302 (e.g., of a natural rubber material) may facilitate in coupling the container and the lid in the hermetically sealed coupling configuration. The polymeric seal 302 may be disposed proximal (e.g., at or near (within approximately 1-2 inches) to the upper edge of the sidewall 108.

In one embodiment, the container 102 may be cylindrical (for better stacking and storage capability) and with exemplary, yet preferable, dimensions set forth in the figures. The container 102 may be shaped and sized to efficiently retain approximately 14-18 organic-based strips, wherein 2 layers of 7 strips 300*a-n* are housed within the container 102 for safe transport by a user. Preferably, however, the container 102, namely the strip cavity 106, is shaped and sized (as indicated in the drawings) to receive strips 300*a-n* in a stacked configuration with two strips (e.g., strip 300*a*, 300*n*) flanking four layers of four strips 300*a-n*, thereby totaling 18 strips. Testing as demonstrated that said beneficial stacked strip configuration, along with the encapsulation of the lid 200 respect to the container 102, maintains the structural integrity and moisture of the strips 300*a-n* without degradation of the same. In other embodiments, the container 102 may be of another size to enable tight packing of a plurality of strips 300*a-n* in another quantity. Preferably, the volume of the strip cavity 106 ranges from approximately 4.0-5.0 $in^3$, thereby facilitating in generating an enhanced shelf life of the strips 300*a-n* in an intended structural condition.

Figure 3:
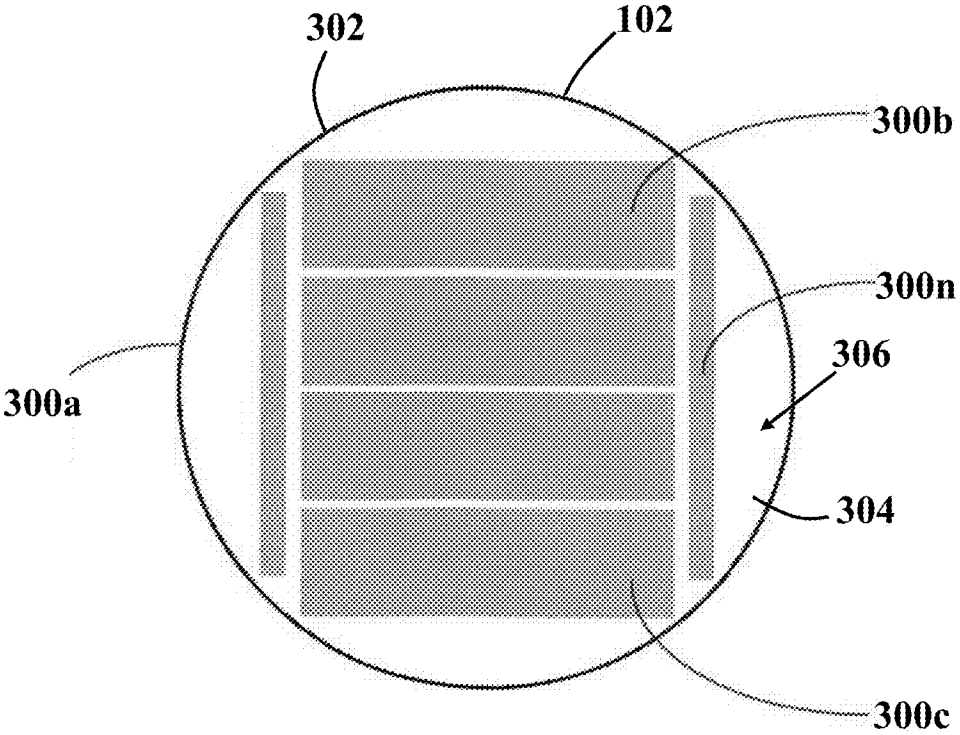
FIG. 3 is a top plan view of the smokeless tobacco alternative kit in FIG. 1 with a plurality of strips disposed and configured therein.

In one embodiment, each of the plurality of strips 30*a-n* include a front elongated surface 506, a rear elongated surface 600 opposing the front elongated surface 506, and with the width 404 separating the front and rear elongated surfaces 506, 600. The 4×4 stacked strip configuration may include the front elongated surface 506 of the each of the plurality of strips 300*a-n* facing upwardly toward the lid 200 (namely the inner surface of the lid 200) and the rear elongated surface 600 of the each of the plurality of strips 300*a-n* facing downward toward an inner surface 306 of a bottom wall 304 of the container 102. The two strips 300*a-n* flanking the 4×4 stacked strip configuration have either the front or rear elongated surfaces 506, 600 facing and disposed proximal to either the first or second end of each of the plurality of strips in the 4×4 stacked strip configuration (this is best illustrated in FIG. 3). In one embodiment, the width 404 is a uniform width separating the length 504 of each of the strips 300*a-n* to maintain uniformity and efficiency in packing.

Figure 7:
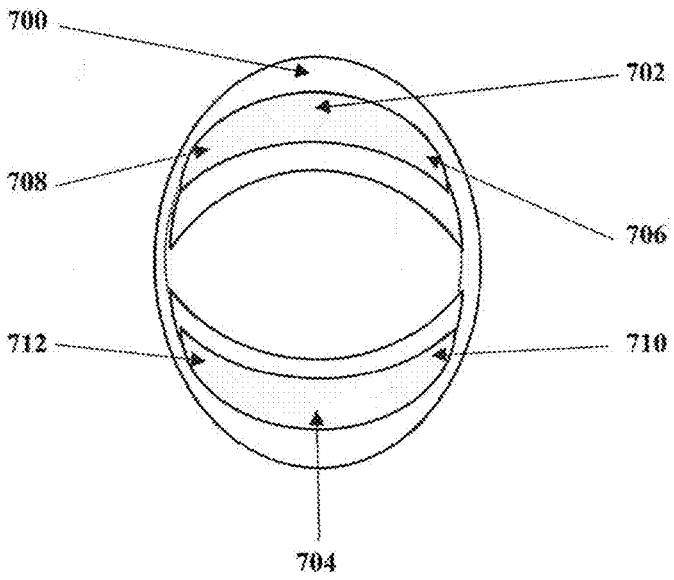
FIG. 7 is a perspective view of an exemplary mouth demonstrating where a chewing strip is placed in accordance with one embodiment of the present invention.
Figure 8:
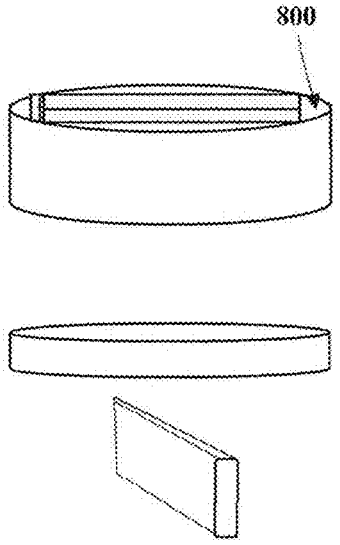
FIGS. 8-12 depict perspective views of an exemplary smokeless tobacco alternative kit in accordance with one embodiment of the present invention.
Figure 9:
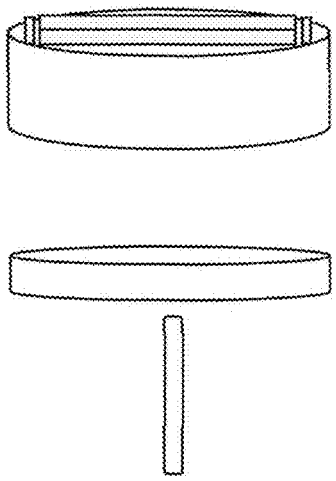
Figure 10:
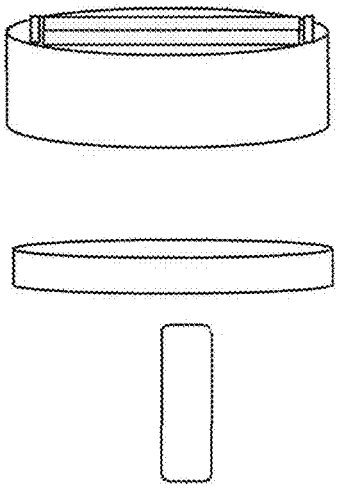
Figure 11:
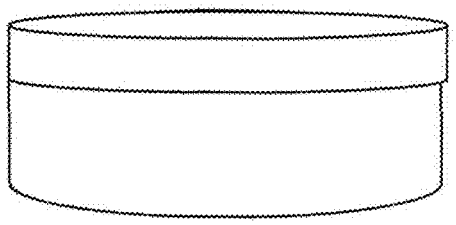
Figure 12:
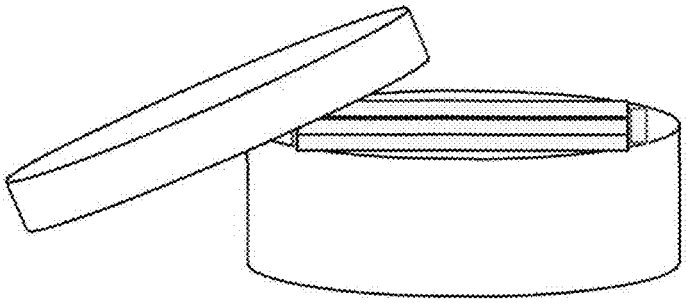

Beneficially, each of strips 300*a-n* are of tobacco-free product that is created to substitute and be an alternative for smokeless tobacco consumers, such as tobacco pouches, snus, long cut tobacco, and fine cut that contain harmful chemicals. Said another way, the strips 300*a-n* are tobacco-free, nicotine-free, and contain all organic compound, providing a user with a comparable experience in a way that is safe, effective, and configured to emulate the sensation of tradition. As best seen in FIGS. 3-6, the strips 300-*an* include a first end 500, a second end 502 opposing the first end 500 of the strip 300*a*, and a strip length 504 separating the first and second ends 500, 502 of the strip 300*a*. In one embodiment, the strip length 504 may range from approximately 1.25-1.75 inches to be effectively positioned and activated within a user's mouth 700 (FIG. 7). In preferred embodiments, the strip length is approximately 1.5 inches.

The strips 300*a-n* may be of a non-woven and absorbent fabric material or sheet 400 surrounding and coupled to an absorbent cotton material body 402. In one embodiment, the non-woven and liquid-absorbent fabric material may be made from a staple fiber (short) and/or long fibers (continuous long), bonded together by chemical, mechanical, heat or solvent treatment. It may also be of a fabric, such as felt, which may not be woven nor knitted. The non-woven and absorbent fabric material may include or consist of polyester, cotton, rayon, and blended non-woven fabric, and may also include a binder resin that binds the fabric together. The liquid-absorbent cotton material body 402 may be of a 100% medical-grade cotton interior, whereby the non-woven and absorbent fabric material or sheet 400 may be coupled to the liquid-absorbent cotton material body 402 through use of a consumable adhesive. The strips 300*a-n* may also be starch-free, so the strips will not stick to mucosa (the lining of a user's gums and inner cheek). Each of the strips 300*a-n* may be of a cylindrical, semi-cylindrical, tear drop, or oblong shape to provide comfort to the user and effective placement of the strips 300*a-n* when placed within a user's mouth. In one embodiment, the thickness of the non-woven and absorbent fabric material or sheet 400 may range from approximately 25-150 mils and the thickness of the liquid-absorbent cotton material body 402 may range from approximately 0.25-0.75 inches. As such, the overall diameter or width 404 of the strips 300*a-n* may be approximately 0.25-0.75 of an inch, but is preferably 0.316" of an inch, whereby the diameter or width 406 of the body 402 may be less than the overall diameter by the thickness of the non-woven sheet material.

In one embodiment, the non-woven and absorbent fabric material or sheet 400 and absorbent cotton material body 402 may span the strip length and absorbed with an organic release liquid of a nicotine-free, tobacco-free, and gluten-free liquid operably configured to transport through the same when subjected to a compressive force, e.g., approximately 0.25 lbf. Said another way, the strips 300*a-b* are infused with a liquid organic, kosher, gluten-free, vegan flavors. Flavoring can be swallowed when released from and transported through the non-woven and absorbent fabric material or sheet 400 and absorbent cotton material body 402. The strips 300*a-n* are to be disposed of by the user after use and not to be swallowed.

As best seen in FIG. 7, in one exemplary method of use, a user will place one of the flavored and infused strips 300*a-n* into the user's mouth between the gum and cheek, preferably at a top center location 702 or lower center location 704 of the user's gums. The user may also place the strips 300*a-n* at the top right location 706, the top left location 708, the bottom right location 710, and the bottom left location 712 of the user's gums. Said another way, the strips 300*a-n* are placed orally between the gum and cheek of a user area known as the vestibule. As stated above, the dimensions of the strips 300*a-n* are comparable to the dimensions of a tobacco pouch, snus pouch, and pinch amount of loose tobacco (long cut/fine cut). Upon oral placement of strip, the consumer will immediately receive the flavor from one or more of the strips 300*a-n* through the compressive force, e.g., approximately 0.2-1 lbf, caused by the user's gum and check. When the consumer desires more flavor, he or she simply applies additional compressive force to the strip by tightening their vestibule causing strip to release more the flavor and infused liquid. In one embodiment, the body 402 and/or non-woven fabric sheet 400 will include approximately 0.01-0.25 ml of infused organic liquid resident therein. In other embodiments, the amount of infused organic liquid will be outside of said ranges and may be infused by submerging the strip into an organic liquid bath for a determined period of time.

Once a flavor of a strip has expired, or a consumer chooses to remove the strip from his or her mouth, it is recommended that the user utilize a new strip from the container 102. Although a specific order of utilizing the strips has been described, the order of executing the steps may be changed relative to the order shown in certain embodiments. Also, two or more steps may be executed concurrently or with partial concurrence in some embodiments. Certain steps may also be omitted for the sake of brevity. In some embodiments, some or all of the process steps may be combined into a single process.

What is claimed is:

1. A smokeless tobacco alternative kit comprising:

a container defining a strip cavity and having a lid, the container and lid operably configured to couple together to encapsulate the strip cavity;

a plurality of strips disposed within the strip cavity, each of the plurality of strips having:

a first end, a second end opposing the first end of the strip, and a strip length separating the first and second ends of the strip; and a non-woven and absorbent fabric material surrounding and coupled to an absorbent cotton material, the non-woven and absorbent fabric material and the absorbent cotton material spanning the strip length and absorbed with an organic release liquid of a nicotine-free, tobacco-free, and gluten-free liquid operably configured to transport through the fabric material and cotton material when subjected to a compressive force.

2. The smokeless tobacco alternative kit according to claim 1, wherein:

the container and the lid are both of a substantially rigid polymeric material.

3. The smokeless tobacco alternative kit according to claim 2, wherein:

the container and the lid are operably configured to couple together in a hermetically sealed coupling configuration.

4. The smokeless tobacco alternative kit according to claim 3, wherein the container further comprises:

a polymeric seal 302 disposed proximal to the upper edge of a sidewall of the container, the polymeric seal 302 coupling the container and the lid in the hermetically sealed coupling configuration.

5. The smokeless tobacco alternative kit according to claim 1, wherein:

the plurality of strips are disposed within the strip cavity in a 4×4 stacked strip configuration with two of the plurality of strips flanking the 4×4 stacked strip configuration.

6. The smokeless tobacco alternative kit according to claim 5, wherein each of the plurality of strips further comprise:

a front elongated surface, a rear elongated surface opposing the front elongated surface, and a width separating the front and rear elongated surfaces, wherein the 4×4 stacked strip configuration includes the front elongated surface of the each of the plurality of strips facing upwardly toward the lid and the rear elongated surface of the each of the plurality of strips facing downward toward an inner surface of a bottom wall of the container and the two of the plurality of strips flanking the 4×4 stacked strip configuration have either the front or rear elongated surfaces facing and disposed proximal to either the first or second end of each of the plurality of strips in the 4×4 stacked strip configuration.

7. The smokeless tobacco alternative kit according to claim 6, wherein:

the width separating the front and rear elongated surfaces uniformly spans the strip length.

8. The smokeless tobacco alternative kit according to claim 1, wherein:

the strip cavity consists essentially of a volume ranging from 4.0-5.0 $in^3$.

9. The smokeless tobacco alternative kit according to claim 1, wherein:

the absorbent cotton material has approximately 0.01-0.25 ml of the organic release liquid absorbed therein.

10. A smokeless tobacco alternative kit comprising:

a container defining a strip cavity and having a lid, the container and lid operably configured to couple together to encapsulate the strip cavity;

a plurality of strips disposed within the strip cavity in a 4×4 stacked strip configuration with two of the plurality of strips flanking the 4×4 stacked strip configuration and each of the plurality of strips having:

a first end, a second end opposing the first end of the strip, and a strip length separating the first and second ends of the strip; and an absorbent fabric material surrounding and coupled to an absorbent cotton material, the absorbent fabric material and the absorbent cotton material spanning the strip length and absorbed with a release liquid of a nicotine-free and tobacco-free liquid operably configured to transport through the fabric material and cotton material when subjected to a compressive force.

11. The smokeless tobacco alternative kit according to claim 10, wherein:

the material surrounding and coupled to the absorbent cotton material is of a non-woven fabric.

12. The smokeless tobacco alternative kit according to claim 11, wherein:

the release liquid is of an organic and gluten-free liquid.

13. The smokeless tobacco alternative kit according to claim 10, wherein:

the container and the lid are both of a substantially rigid polymeric material.

14. The smokeless tobacco alternative kit according to claim 13, wherein:

the container and the lid are operably configured to couple together in a hermetically sealed coupling configuration.

15. The smokeless tobacco alternative kit according to claim 14, wherein the container further comprises:

a polymeric seal disposed proximal to the upper edge of a sidewall of the container, the polymeric seal coupling the container and the lid in the hermetically sealed coupling configuration.

16. The smokeless tobacco alternative kit according to claim 10, wherein each of the plurality of strips further comprise:

a front elongated surface, a rear elongated surface opposing the front elongated surface, and a width separating the front and rear elongated surfaces, wherein the 4×4 stacked strip configuration includes the front elongated surface of the each of the plurality of strips facing upwardly toward the lid and the rear elongated surface of the each of the plurality of strips facing downward toward an inner surface of a bottom wall of the container and the two of the plurality of strips flanking the 4×4 stacked strip configuration have either the front or rear elongated surfaces facing and disposed proximal to either the first or second end of each of the plurality of strips in the 4×4 stacked strip configuration.

17. The smokeless tobacco alternative kit according to claim 16, wherein:

the width separating the front and rear elongated surfaces uniformly spans the strip length.

18. The smokeless tobacco alternative kit according to claim 17, wherein:

the strip cavity consists essentially of a volume ranging from 4.0-5.0 $in^3$.

19. The smokeless tobacco alternative kit according to claim 18, wherein:

the absorbent cotton material has approximately 0.01-0.25 ml of the organic release liquid absorbed therein.

* * * * *